US006332288B1

(12) United States Patent
Guillemet et al.

(10) Patent No.: US 6,332,288 B1
(45) Date of Patent: Dec. 25, 2001

(54) WINDOW SASH PIVOT ASSEMBLY

(75) Inventors: Guy Guillemet, Terrebonne; Yvon Soucy, Laval; Daniel Varin, Brossard, all of (CA)

(73) Assignee: Ferco Architectural Hardware, Laval (CA)

( * ) Notice: Subject to any disclaimer, the term of this patent is extended or adjusted under 35 U.S.C. 154(b) by 0 days.

(21) Appl. No.: 09/757,797

(22) Filed: Jan. 11, 2001

(51) Int. Cl.[7] ..... E05D 15/22

(52) U.S. Cl. ..... 49/181

(58) Field of Search ..... 49/176, 181, 445, 49/453, 454, 455; 16/193

(56) References Cited

U.S. PATENT DOCUMENTS 5,243,783 * 9/1993 Schmidt et al. ..... 49/181
5,301,467 * 4/1994 Schmidt et al. ..... 49/181
5,806,243 * 9/1998 Prete et al. ..... 49/181

* cited by examiner

*Primary Examiner*—Jerry Redman
(74) *Attorney, Agent, or Firm*—Swabey Ogilvy Renault; Guy Houle

(57) ABSTRACT

A sash pivot assembly, for supporting a window sash in sliding and pivotal displacement within a window frame, is comprised of a housing having a pivot rotor rotatively mounted therein. The pivot rotor has a slot comprising a spring clip defined by a U-shaped spring comprising lateral side arms having inwardly embossed portions, for snap-locking and snap-releasing engagement with a sash pivot.

19 Claims, 3 Drawing Sheets

WINDOW SASH PIVOT ASSEMBLY

FIELD OF THE INVENTION

The present invention relates generally to double hung windows with tiltable removable sashes, and more importantly, but not exclusively, to improvements to the window sash pivot assembly.

BACKGROUND OF THE INVENTION

Double hung windows known in the art comprise a pair of vertically translating window sashes. The window sashes slide about channels located alongside the window jambs of a window frame. Either sash can overlap the other sash to provide varying openings of the window. A window sash generally comprises, at its top end, a locking mechanism to engage the window sash in a stationary position along the window jambs. The window sashes may also be independently attached to a biasing mechanism, continuously pulling the window sashes upward. Another interesting feature of the double hung windows is provided by a pivoting mechanism, which allows for the window sashes to be inclined inwardly. This allows, for example, the maintenance and the cleaning of both faces of a window sash and glass panel from the inside.

Pivot assemblies have been provided to achieve this pivoting while enabling the sliding of the window sash within the channels of the window jambs. The pivoting feature for inclining window sashes is allowed by pivoting mechanisms enclosed within the pivot assemblies.

Different models of pivot assemblies have been introduced with various options. U.S. Pat. No. 5,127,192, issued on Jul. 7, 1992 to Cross discloses a pivot assembly defining a housing which slides in a track and receives a rotor. The rotor is rotatively connected to a sash pivot, thus permitting the inclination of the window sash about the window jambs. Furthermore, the rotation of the rotor engages the housing in arresting contact with the track for preventing the housing to move along the track when the sash is rotated. This feature allows for the window sash to have a stationary pivoting axis between the window jambs.

It is known from U.S. Pat. No. 5,127,192 to provide an obstruction block for locking the window sash in the housing. The obstruction block closes a slot that provides an outlet for removing the window sash from the housing. In order to pull the window sash out of the housing, the obstruction blocks must be taken off. To do so, a screwdriver or the like is needed to release the obstruction block from the housing. This renders the removal of the window sash from the housing inconvenient. It also involves a risk of losing the obstruction blocks and making the assembly insecure.

Furthermore, U.S. Pat. No. 5,127,192 has not foreseen the risk of longitudinal dislocation of the sash pivots. Although the sash pivot is secured laterally in the rotor, the sash pivot is free to slide out of the rotor longitudinally. During transportation and installation of the window sash, the deflection or bowing of the frame may lead to such longitudinal dislocation.

U.S. Pat. No. 5,243,783, issued on Sep. 14, 1993 to Schmidt et al. provides improvements as it involves a pivot assembly comprising a pivot with a flange at an end thereof enclosed in a housing also comprising flanges. This configuration prevents the longitudinal dislocation aforementioned.

U.S. Pat. No. 5,243,783 also discloses a slot in the pivot rotor for removing the window sash from the housing. In this case, the slot is blocked by a retainer spring, having an end fixedly attached to the housing and an opposed free end obstructing the slot. The pivot of the window sash is inserted into the slot by depressing the free end of the retainer spring. The retainer spring resiliently moves back over the slot, thereby preventing the pivot from slipping out of the slot. To remove the window sash pivot from the slot, the retainer spring must be manually pushed inwardly. This makes the removal of the window sash from the pivot assembly intricate as a person can only remove one side of the window sash at a time, for the retainer spring must be pushed manually.

The removal of the window sash, one side at a time, causes further problems. When only one side of the window sash is released from the pivot assemblies, the window sash is tilted from its normal perpendicular position about the window jambs. In doing so, the flanges of the pivot tend to engage and pry against the flanges of the housing. This prying sometimes causes a portion of the flanges of the housing to crack off. Parts of the pivot assembly must then be replaced, thus increasing material costs and installation time.

Furthermore, a cantilever-like retainer spring such as disclosed in U.S. Pat. No. 5,243,783 must be of low stiffness to be pressed in manually. Consequently, such springs are not a reliable and durable solution.

U.S. Pat. No. 5,924,243, issued on Jul. 20, 1999 to Polowinczak et al. introduces a pivot assembly including a rotor rotatably disposed therein. The rotor comprises slots for receiving a pivot connected to a window sash. The slots are for receiving the pivot and a collar is located adjacent an end thereof. The slots comprise angled surfaces in order to provide the pivot and the collar with clearance in order to be released from the rotor without prying flanges at an opening of the rotor, as described previously. The collar also prevents the longitudinal dislocation of the window sash from the rotor in case of bowing of the window frame during transportation and installation.

The pivot assembly of U.S. Pat. No. 5,924,243 also defines a slot for releasing the window sash therefrom. A spring may be releasably installed on the lateral walls defining the slot in order to obstruct the slot. To remove the window sash pivot from the rotor, the spring must be removed beforehand, thereby rendering this operation inconvenient. If the spring is not used, the window sash is no longer secured in the rotor when tilted horizontally and may fall out.

It would be desirable to provide a window sash pivot assembly combining the advantages described above, while encompassing the problems found in the prior art. It would be of further interest to provide a window sash pivot assembly proposing a simple method for releasing the window sash therefrom. Furthermore, adding the durability and ease of assembly and repair features to such a system while keeping it inexpensive will be a step forward in the conception of window sash pivot assemblies.

DISCLOSURE OF THE INVENTION

It is an aim of the present invention to provide a sash pivot assembly for supporting a window sash, comprising a durable system for snap-locking and snap-releasing a sash pivot from the sash pivot assembly.

SUMMARY OF THE INVENTION

According to the above aim of the present invention, and according to a broad aspect thereof, there is provided a sash pivot assembly for supporting a window sash. The sash pivot assembly is slidably mounted in a channel alongside a window jamb. The pivot assembly comprises a housing defining a bearing surface for rotatively supporting a pivot rotor. A blocking mechanism has at least one bearing member for releasably engaging the assembly in an arresting position within a window jamb. A sash pivot is adapted to be mounted to the window sash. The pivot rotor defines a generally cylindrical body. A slot is longitudinally disposed in the cylindrical body for receiving the sash pivot and a spring clip is disposed in the slot and defines a resilient throat therebetween for snap-locking and snap-releasing engagement with the sash pivot.

According to a further broad aspect of the present invention there is provided a pivot rotor mechanism for a sash pivot assembly for supporting a window sash. The pivot rotor mechanism comprises a sash pivot adapted to be mounted in a window sash. A pivot rotor defines a generally cylindrical body adapted for rotative contact engagement with a sash pivot assembly housing. The rotor has a slot longitudinally disposed therein for receiving the sash pivot. A spring clip is disposed in the slot and defines a resilient throat therebetween for snap-locking and snap-releasing engagement with the sash pivot.

BRIEF DESCRIPTION OF THE DRAWINGS

A preferred embodiment of the present invention will now be described in detail having reference to the accompanying drawings in which.

DESCRIPTION OF THE PREFERRED EMBODIMENTS

Figure 1:
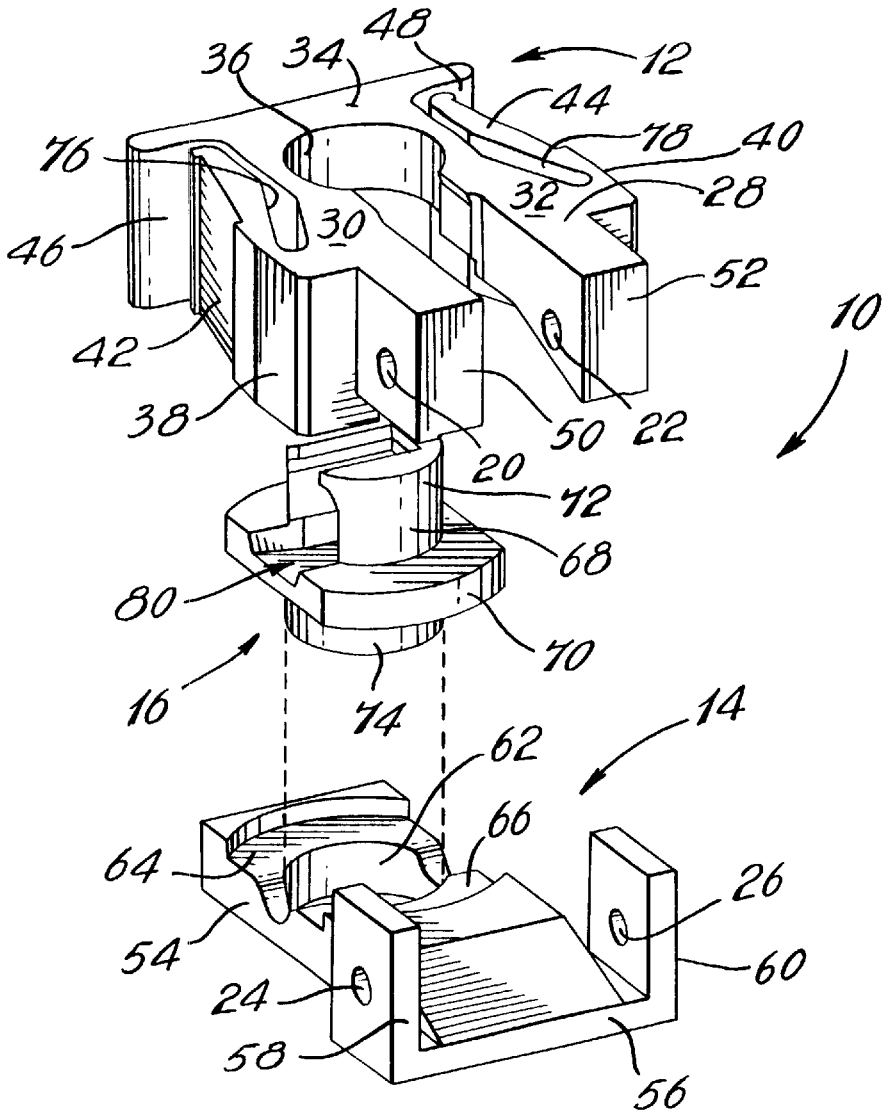
FIG. 1 is an schematic exploded view of a pivot assembly constructed in accordance with the present invention.
Figure 2:
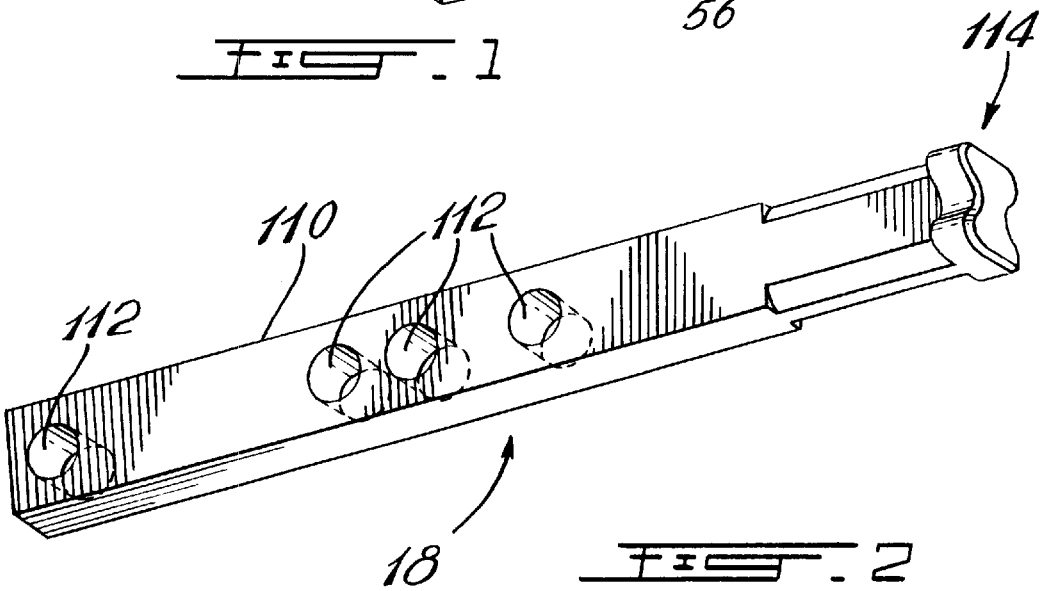
FIG. 2 is a perspective view of a sash pivot constructed in accordance with the present invention.

According to the drawings and more particularly to FIG. 1, a window sash pivot assembly of the present invention is generally shown at 10 in an exploded view. The assembly 10 comprises a first housing member 12, a second housing member 14 and a pivot rotor 16. The assembly 10 further comprises a sash pivot 18 as shown in FIG. 2.

The first housing member 12 and the second housing member 14 are pivotally mounted by pins joining holes 20 and 22 of the first housing member to holes 24 and 26 of the second housing member, respectively. The pivot rotor 16 is enclosed by the first and second housing member assembly. The first and second housing member assembly is slidably mounted in a channel alongside a window jamb. The assembly may also comprise attachment means (not shown) as is well known in the art for connecting to a biasing mechanism within the window jamb.

The first housing member 12 is defined by a generally U-shaped piece 28. The U-shaped piece 28 comprises lateral walls 30 and 32 and a bottom wall 34. The lateral walls 30 and 32 and the bottom wall 34 define a circular shaped bearing surface 36.

The lateral walls 30 and 32 comprise sliding faces 38 and 40, respectively. The sliding faces 38 and 40 laterally extend outward from the lateral walls. Cantilever arms 42 and 44 project downward from sliding faces 38 and 40, respectively. The cantilever arms 42 and 44 are resiliently biased inward of the U-shaped piece 28. The bottom wall 34 comprises flanges 46 and 48 extending laterally therefrom.

When the first housing member 12 is slidably disposed in the window jamb channel, the inner faces of the lateral walls of the channel are in slidable contact with the sliding faces 38 and 40 of the lateral walls 30 and 32, and with the flanges 46 and 48 of the bottom wall 34. The cantilever arms 42 and 44 are resiliently biased inward to avoid contact with the lateral walls of the channel. Finally, the lateral walls 30 and 32 have integrally formed top ends 50 and 52. The top ends 50 and 52 are provided with holes 20 and 22 for receiving pins for engaging a pivotable connection between the first housing member 12 and the second housing member 14.

The second housing member 14 is defined by a generally rectangular piece 54. A U-shaped formation 56 is formed at an end of the rectangular piece 54. The U-shaped frame 56 comprises lateral portions 58 and 60. Holes 24 and 26 are formed on the lateral portions 58 and 60. As described above, the holes 24 and 26 are opposed to the holes 20 and 22 and connected thereto by pins. This provides a pivotal connection of the first housing member 12 to the second housing member 14. Furthermore, the outer faces of the lateral portions 58 and 60 are disposed in slidable contact with the inner faces of the window jamb channel. The rectangular piece 54 is provided at an opposed end with a bearing surface 62 and ridges 64 and 66.

The pivot rotor 16 comprises a generally cylindrical body 68. An oblong shaped collar 70 is generally located in the middle thereof. The collar 70 separates the cylindrical body 68 in a front portion 72 and a rear portion 74.

The pivot rotor 16 is enclosed in the assembly of the first and second housing members 12 and 14. The front portion 72 of the pivot rotor 16 is received in rotative contact with the bearing surface 36 of the first housing member 12. The rear portion 74 is in rotative contact with the bearing surface 62 of the second housing member 14. The oblong-shaped collar is enclosed in the ridges 64 and 66 of the second housing member 14.

When the pivot rotor 16 is turned in the assembly, the oblong-shaped collar 70 reaches a position where it extends laterally from the rectangular piece 54 of the second housing member 14. In doing so, the oblong-shaped collar 70 engages in operative contact with the inner surfaces 76 and 78 of the cantilever arms 42 and 44, respectively. In consequence thereof, the cantilever arms 42 and 44 are outwardly pushed toward the inner faces of the window jamb channel. In doing so, the window sash pivot assembly 10 is locked in the window jamb channel, preventing further slide of the assembly, and thus, of the window sash. This position is referred to as the assembly locking position.

Figure 3:
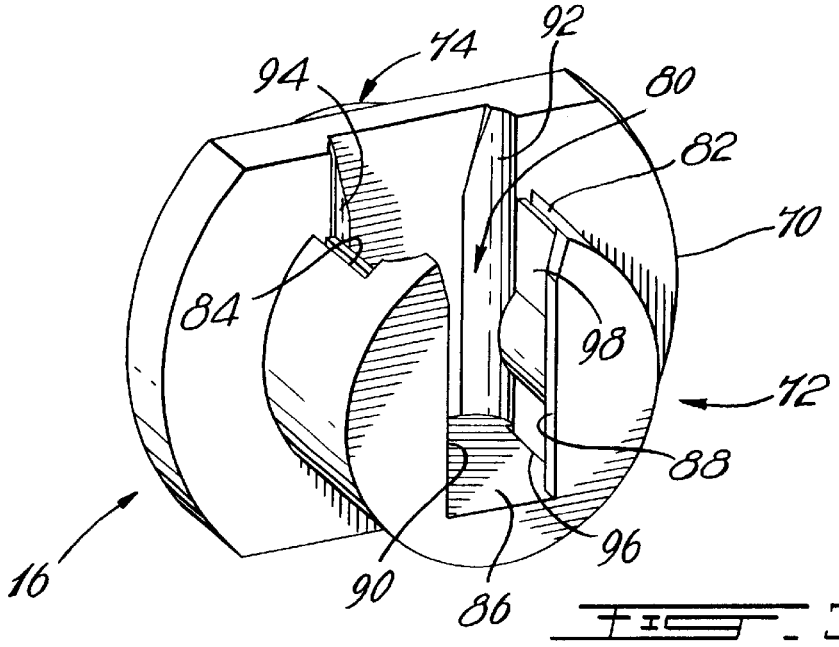
FIG. 3 is a perspective view of a pivot rotor constructed in accordance with the present invention.

The pivot rotor 16 as shown in FIG. 3, further comprises a slot 80. The slot 80 defines opposed lateral faces 82 and 84 and a bottom face 86. Flanges 88 and 90 are located at an opening of the slot 80. The slot 80 extends at an end opposed to the opening in the collar 70. The extension of the slot 80 in the collar 70 is characterized by rounded edges 92 and 94. Apertures 96 are provided in the bottom face 86 and are disposed adjacent the lateral faces 82 and 84.

Figure 4:
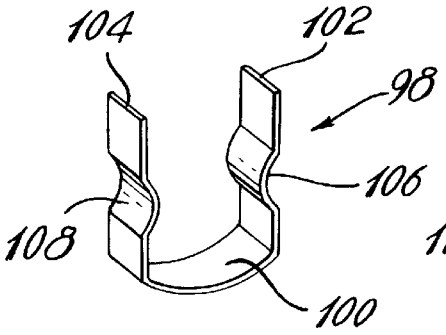
FIG. 4 is a perspective view of the spring clip removably secured within the rotor.

A spring clip is generally shown at 98 in FIG. 4. The spring clip 98 is defined by a U-shaped spring 100 comprising lateral sides 102 and 104. The lateral sides 102 and 104 comprise inwardly embossed portions 106 and 108, thereby defining a resilient throat.

The spring clip 98 is mounted in the pivot rotor 16 with the clip lateral side arms 102 and 104 extending through the apertures 96 at opposed ends of the bottom face 86. The lateral side arms 102 and 104 of the spring clip 98 are resiliently biased outward and are thus kept in the pivot rotor 16 by pressing against the lateral faces 82 and 84 of the slot 80. In consequence thereof, the spring clip 98 is secured but can easily be replaced by pushing it out of the slot when the rotor is removed from the assembly.

The sash pivot 18, as shown in FIG. 2, is defined by a generally slender rectangular rod 110. Holes 112 are disposed therein to provide attachment means to a window sash (not shown).

Figure 5:
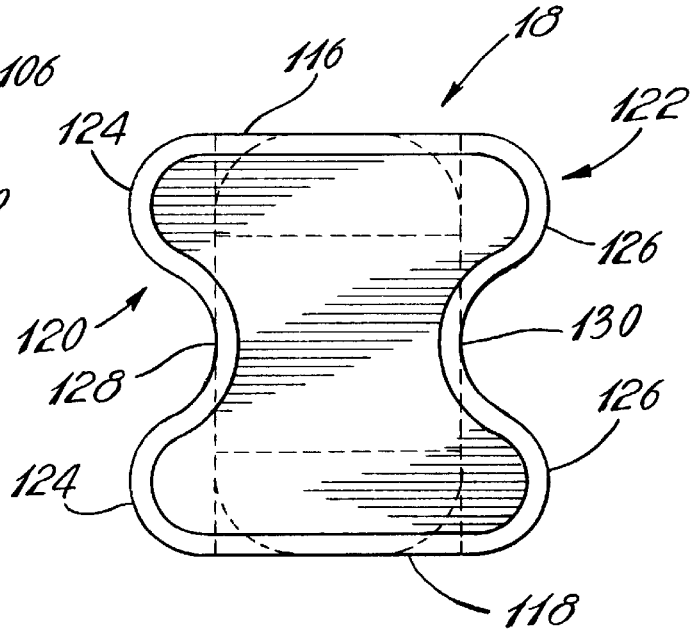
FIG. 5 is a side elevation view of the sash pivot.

A pivot head 114 is located at an end of the slender rectangular rod 110. As shown in FIG. 5, the pivot head is defined by a top face 116, a bottom face 118 and lateral faces 120 and 122. The lateral face 120 generally defines a wave-like shape comprising cam surfaces 124 separated by a groove 128. Similarly, the lateral face 122 comprises cam surfaces 126, separated by a groove 130.

The sash pivot 18, when secured to a sash, is inserted in the pivot rotor 16 as follows. The pivot head 114 is engaged in the slot 80 with the lateral faces 120 and 122 aligned with the lateral faces 82 and 84 of the slot 80. When the cam surfaces 124 and 126 adjacent the bottom face 118 of the pivot head 114 come in contact with the inwardly embossed portions 106 and 108 of the spring clip 98, additional manual force is needed to snap the pivot head past the inwardly embossed portions 106 and 108. Once the sash pivot 18 is snapped into the pivot rotor 16, the inwardly embossed portions 106 and 108 are enclosed in the grooves 128 and 130 of the pivot head 114. Consequently, the sash pivot 18 is releasably locked in the pivot rotor 16. This position is referred to as the snap-locking engagement. To release the sash pivot 18 from the snap-locking engagement in the pivot rotor 16, an additional manual pull is necessary. This pull is referred to as the snap-release engagement.

Figure 6:
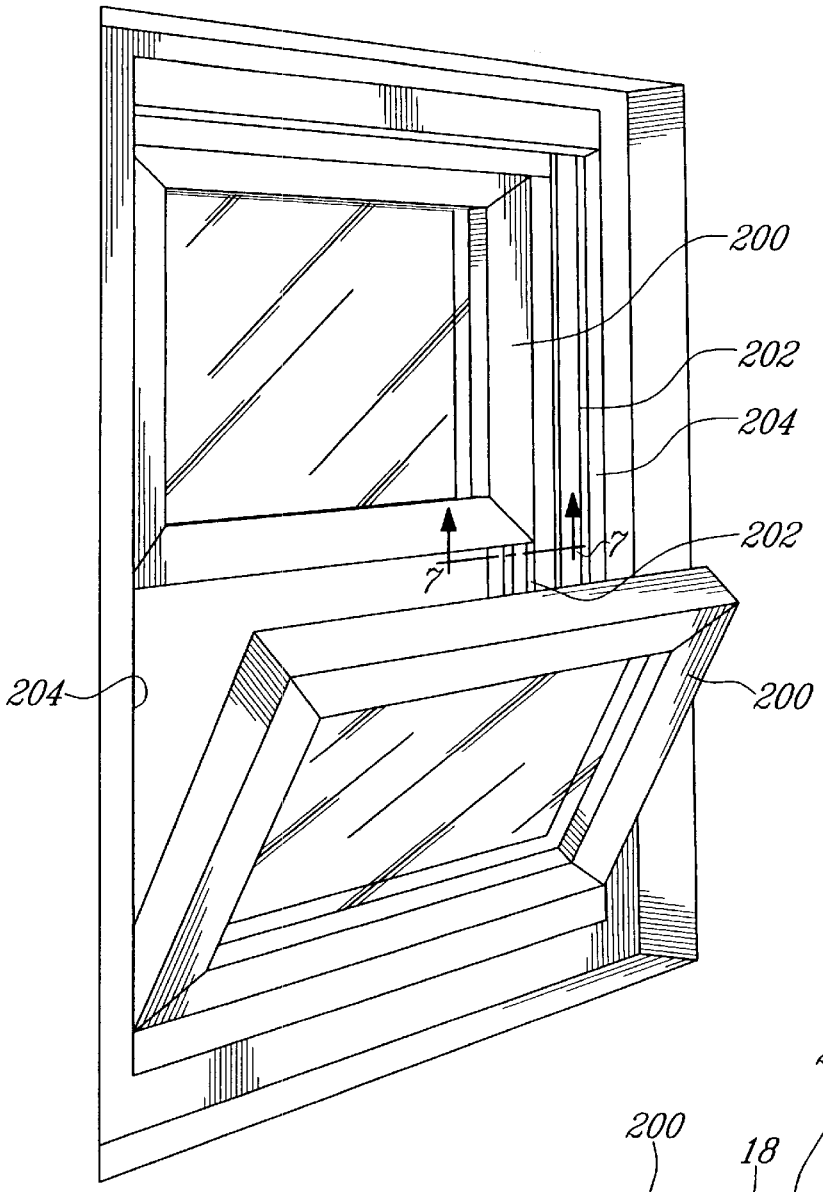
FIG. 6 is a schematic perspective view of a double-hung window mounted with pivot assemblies in accordance with the present invention.
Figure 7:
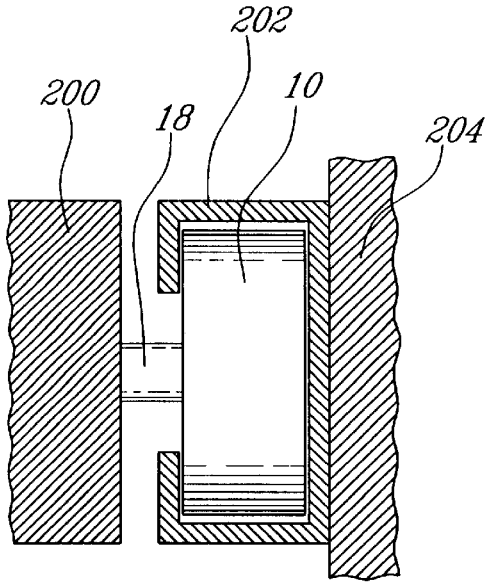
FIG. 7 is a schematic cross-sectional view of a slidably mounted pivot assembly of FIG. 6 taken from line 7—7 of FIG. 6.

Window sashes are generally shown at 200 in FIG. 6. The window sashes 200 are mounted in channels 202 of window jambs 204. As shown in FIG. 7, a sash pivot 18 is connected in the window sash 200 an is secured within the window sash pivot assembly 10.

The method herein disclosed for releasably locking the sash pivot 18 in the pivot rotor 16 and consequently the window sash in the window sash pivot assembly, is efficient and does not require any tools. This is an improvement over the previous systems as it renders the present invention convenient in use.

Furthermore, the inwardly embossed portions of the spring clip provide a more durable solution than the free end retainer spring solution of U.S. Pat. No. 5,243,783. In effect, an arch is structurally stronger than a cantilever-like spring, which will be subject to fatigue earlier.

The present invention has also kept the feature of preventing the longitudinal dislocation of the sash pivot 18 from the pivot rotor 16. This is done by the pivot head 114 of the sash pivot 18 engaging contact with the flanges 88 and 90 of the slot 80 of the pivot rotor 16. If the sash pivot 18 is pulled inwardly, for example when the window frame bows during transportation and installation, the flanges 88 and 90 will prevent the sash pivot 18 from being pulled out of the pivot rotor 16.

Another improvement of the present invention relates to the rounded edges 92 and 94 in the collar 70 of the pivot rotor 16. These rounded edges provide a clearance if the pivot head were to be inclined to be released from the snap-locking engagement. This feature ensures that the flanges 88 and 90 will not be pried and cracked off upon snap-release or snap-locking engagement of the sash pivot 18 and the pivot rotor 16.

It is within the ambit of the present invention to cover any obvious modifications of the embodiments described herein, provided such modifications fall within the scope of the appended claims.

What is claimed is:

1. A sash pivot assembly for supporting a window sash, wherein said sash pivot assembly is slidably mounted in a channel alongside a window jamb, said pivot assembly comprising:

a housing defining a bearing surface for rotatively supporting a pivot rotor;

a blocking mechanism having at least one bearing member for releasably engaging said assembly in an arresting position within a window jamb;

a sash pivot adapted to be mounted to said window sash;

said pivot rotor defining a generally cylindrical body;

a slot longitudinally disposed in said cylindrical body for receiving said sash pivot; and a spring clip disposed in said slot and defining a resilient throat therebetween for snap-locking and snap-releasing engagement with said sash pivot.

2. The sash pivot assembly according to claim 1, wherein said spring clip is defined by a U-shaped spring having lateral side arms provided with inwardly embossed portions to define said resilient throat therebetween.

3. The sash pivot assembly according to claim 2, wherein the sash pivot comprises a pivot head laterally extending at an end thereof for engaging contact within said spring clip of said pivot rotor.

4. The sash pivot assembly according to claim 3, wherein said pivot head comprises opposed lateral walls defining outwardly projecting cam surfaces separated by a groove, said grooves enclosing said embossed portions of said lateral sides of said spring clip in said snap-locking engagement of said sash pivot.

5. The sash pivot assembly according to claim 3, wherein said flanges are disposed along an opening of said slot for engaging contact with the pivot head to prevent said pivot from being pulled out of said opening in a direction generally parallel to a longitudinal axis of said sash pivot.

6. The sash pivot assembly according to claim 5, wherein said slot further comprises rounded edges at an opposed end thereof, for providing clearance to said pivot head of said sash pivot when said pivot head is angled for obtaining said snap-release or said snap-locking engagement.

7. The sash pivot assembly according to claim 1, wherein said housing comprises arms resiliently biased in a retracted position within said housing.

8. The sash pivot assembly according to claim 7, wherein said pivot rotor comprises an oblong-shaped collar in operative contact with said arms for pushing said arms outwardly from said housing to engage in locking contact with lateral walls of said channel of said window jamb.

9. The sash pivot assembly according to claim 1, wherein said housing is defined by pivotally fastened members for enclosing said pivot rotor.

10. The sash pivot assembly according to claim 1, wherein said spring clip is removably secured in said pivot rotor.

11. The sash pivot assembly according to claim 1, wherein said housing comprises means for attachment to a window sash biasing mechanism.

12. A pivot rotor mechanism for a sash pivot assembly for supporting a window sash and comprising:

a sash pivot adapted to be mounted in a window sash;

a pivot rotor defining a generally cylindrical body adapted for rotative contact engagement with a sash pivot assembly housing, said rotor having a slot longitudinally disposed therein for receiving said sash pivot, and a spring clip disposed in said slot and defining a resilient throat therebetween for snap-locking and snap-releasing engagement with said sash pivot.

13. The pivot rotor mechanism according to claim 12, wherein said spring clip is defined by a U-shaped spring having lateral side arms provided with inwardly embossed portions to define said resilient throat therebetween.

14. The pivot rotor mechanism according to claim 13, wherein said sash pivot comprises a pivot head laterally extending at an end thereof for engaging contact within said spring clip of said pivot rotor.

15. The pivot rotor mechanism according to claim 14, wherein said pivot head comprises opposed lateral walls defining outwardly projecting cam surfaces separated by a groove, said grooves enclosing said embossed portions of said lateral sides of said spring clip in said snap-locking engagement of said sash pivot.

16. The pivot rotor mechanism according to claim 14, wherein flanges are disposed along an opening of said slot for engaging contact with said pivot head to prevent said pivot from being pulled out of said opening in a direction generally parallel to a longitudinal axis of said sash pivot.

17. The pivot rotor mechanism according to claim 16, wherein said slot has rounded edges at an opposed end thereof, for providing clearance to said pivot head of said sash pivot when said pivot head is angled for obtaining said snap-release or said snap-locking engagement.

18. The pivot rotor mechanism according to claim 12, wherein said pivot rotor has an oblong-shaped collar adapted for operatively engaging contact with a blocking mechanism enclosed within said housing to engage said housing in an arresting contact with said window jamb.

19. The pivot rotor mechanism according to claim 12, wherein said spring clip is removably secured in said pivot rotor.

* * * * *